US008215975B2

(12) United States Patent
Zhou

(10) Patent No.: US 8,215,975 B2
(45) Date of Patent: Jul. 10, 2012

(54) WATERPROOF INSULATED CONNECTOR

(76) Inventor: Gang Zhou, Chengdu (CN)

( * ) Notice: Subject to any disclaimer, the term of this patent is extended or adjusted under 35 U.S.C. 154(b) by 0 days.

(21) Appl. No.: 13/003,375

(22) PCT Filed: Jul. 9, 2009

(86) PCT No.: PCT/CN2009/072705

§ 371 (c)(1),
(2), (4) Date: Jan. 10, 2011

(87) PCT Pub. No.: WO2010/003379

PCT Pub. Date: Jan. 14, 2010

(65) Prior Publication Data

US 2011/0165793 A1 Jul. 7, 2011

(30) Foreign Application Priority Data

Jul. 10, 2008 (CN) ..... 2008 1 0045509

(51) Int. Cl.
*H01R 29/00* (2006.01)

(52) U.S. Cl. ..... 439/188

(58) Field of Classification Search ..... 439/589, 439/188, 281, 282

See application file for complete search history.

(56) References Cited

U.S. PATENT DOCUMENTS

| | | | | |
|---|---|---|---|---|
| 3,496,500 | A * | 2/1970 | Romary | 335/205 |
| 4,773,032 | A * | 9/1988 | Uehara et al. | 708/134 |
| 5,052,484 | A * | 10/1991 | Gesta | 166/55 |
| 7,040,909 | B2 * | 5/2006 | Cairns | 439/271 |
| 7,355,122 | B2 | 4/2008 | Moore | |
| 7,727,020 | B2 * | 6/2010 | Gladd et al. | 439/607.41 |

FOREIGN PATENT DOCUMENTS

| | | | |
|---|---|---|---|
| CN | 1115914 | A | 1/1996 |
| CN | 1334620 | A | 2/2002 |
| CN | 2603543 | Y | 2/2004 |
| CN | 2612100 | Y | 4/2004 |
| CN | 2634674 | Y | 8/2004 |
| CN | 2735431 | Y | 10/2005 |
| CN | 1885629 | A | 12/2006 |
| CN | 101071943 | A | 11/2007 |
| CN | 201270325 | Y | 7/2009 |

* cited by examiner

*Primary Examiner* — Phuong Dinh
(74) *Attorney, Agent, or Firm* — Anova Law Group, PLLC

(57) ABSTRACT

The invention relates to a waterproof insulated connector, which modifies any electrical connection of a power supply, a USB, a VGA, a socket of electric equipment, an SD, an MS, an MMC and the like into a connection that is completely waterproof and insulated. Whether a connector of the electric equipment is connected or not, the plug and the socket are waterproof and can be completely and directly connected in water or other media without damaging the electric equipment and causing electric shock accidents, and multiple electric passages can be insulated from each other. The waterproof performance is realized by an isolating cavity consisting of a gating isolate component made of a dielectric elastomer, a shell and a hollow waterproof ring. The waterproof isolation connector and the method thereof have innovation in technology and lead users to an electric world with high safety and humanization.

4 Claims, 9 Drawing Sheets

WATERPROOF INSULATED CONNECTOR

CROSS-REFERENCES TO RELATED APPLICATIONS

The present application claims the benefit of the Chinese Patent Application No. 200810045509.2, filed Jul. 10, 2008, which is incorporated herein by reference in its entirety and for all purposes.

THE TECHNICAL FIELD

The invention relates to a waterproof insulated connector, which modifies any electric connection of a power supply, a USB, a VGA, a socket of electric equipment, an SD, an MS, an MMS and the like into a connection that is completely water-proof and insulated. That is to say whether the socket and plug of the electric equipment is connected or not, the plug and the socket are waterproof and can be completely and directly connected in water or other media.

BACKGROUND

Existing so-called waterproof connection is realized by the encapsulated connection made of the socket and the plug (female parts and male parts, etc.). That is, when the plug is not plugged in, the connector is not waterproof, as described in China Utility Model Patents ZL03228669.4, ZL03228668.6, ZL03229142.6, and ZL200520116143.0, Invention Patent Applications 200610093084.3, 200710028526.0, and 95106652.8, and Invention Patent ZL01123034.7.

Waterproof insulated connector disclosed in the invention has the feature that, whether or not the plug and the socket are connected, they are waterproof and can be directly connected in water or other media completely without damaging the electrical equipment or causing electric shock accidents, and multiple electric passages can be insulated from one another. The waterproof feature is realized by having a gating isolate component comprising a movable conductor and a dielectric elastomer, and an isolating cavity having a shell and a hollow waterproof ring.

The waterproof insulated connector disclosed in the invention and the manufacturing method thereof have technological innovation and have substantial differences from the existing technologies. It will lead us into an electric world with high safety and humanization.

SUMMARY OF INVENTION

The objective of the invention is to provide a type of waterproof insulated connector, with which the electrical devices (mobile phone, computer, electrical appliances and the like) are completely waterproof whether they are connected with other electrical devices. The plug and the socket of the electrical devices can operate normally in water or other media whether they are connected so as to realize direct waterproof insulated connection of electrified devices in water or other media, and the multiple electric passages can be insulated from one another.

The technical scheme of the invention is as follows:

A type of waterproof insulated connector, which is characterized in that: such waterproof insulated connector comprises a gating isolate component made of a movable conductor and dielectric elastomer, contacts, and an isolating cavity. The gating isolate component isolates passing of water and other media and only allows conduction of electricity through the conductor. In addition, the component may be subject to elastic deformation to move the movable conductor within the elastic deformation range of the dielectric elastomer, so as to realize disconnection and connection between the movable conductor and contacts. The contacts connect with the object with which the interface connects. The isolating cavity is composed of an elastic deformation device made of a shell and a hollow waterproof ring and surrounds movable conductor.

The additional technical scheme of the invention is as follows:

Preferably, the dielectric elastomer in the isolating gate component is kept at an initial balanced position when it receives a force smaller than the pushing pressure, and is kept at the final balanced position when receiving a force larger the pushing pressure, preventing the passage of water and other media from contacting the contact.

Preferably, the isolating cavity-comprises a shell and a hollow waterproof ring. The isolating cavity is deformed as the hollow waterproof ring undergoes elastic deformation when connection occurs, which isolates the movable conductors. In addition, the movable conductors exert pressure on each other to push the gating isolate component to enable the contact of the plug and the socket to conduct via conductors.

Preferably, said isolating cavity comprises the shell and the hollow waterproof ring at the opening of the shell. The contacts are installed inside the shell and connects with the object received by the connector. The dielectric elastomer of the gating isolate component is affixed at the opening of the shell, and conductors are affixed on the elastomer and pass through it. Through the deformation of the dielectric elastomer, the conductor can engage with or disengage from the contacts. The gating isolate component and the shell embrace the contact completely.

Preferably, said technical scheme is applicable to an electric equipment, said electric equipment comprises said waterproof insulated connector. The electric equipment connects with the outside via the waterproof insulated connector. A waterproof case is formed by the waterproof insulation layer and the shell of the connector to enfold the electric equipment.

The invention has the beneficial effects as follows: 1. The gating isolate component and the isolating cavity work together to isolate the contact of the plug and the socket to enable the electrical appliance to function normally in water or other media, mainly due to the reason that the gating isolate component isolates the contacts of the plug and the socket from the media to prevent the plug and socket from being short-circuited by the medium. 2. In the initial state of contact of the plug and the socket, the isolating cavity is formed to isolate movable conductors. The continued exertion of pressure brings the plug and socket to the final state of contact, which enables the contact of the plug and the socket to realize the waterproof and insulated connection via movable conductors. Thus the electrical appliance can be directly connected in water or other media without damaging it or causing electric shocks.

DESCRIPTIONS OF DRAWINGS

The invention is described using examples shown in the drawings, among which

DETAILED DESCRIPTION OF THE EMBODIMENT

Figure 1:
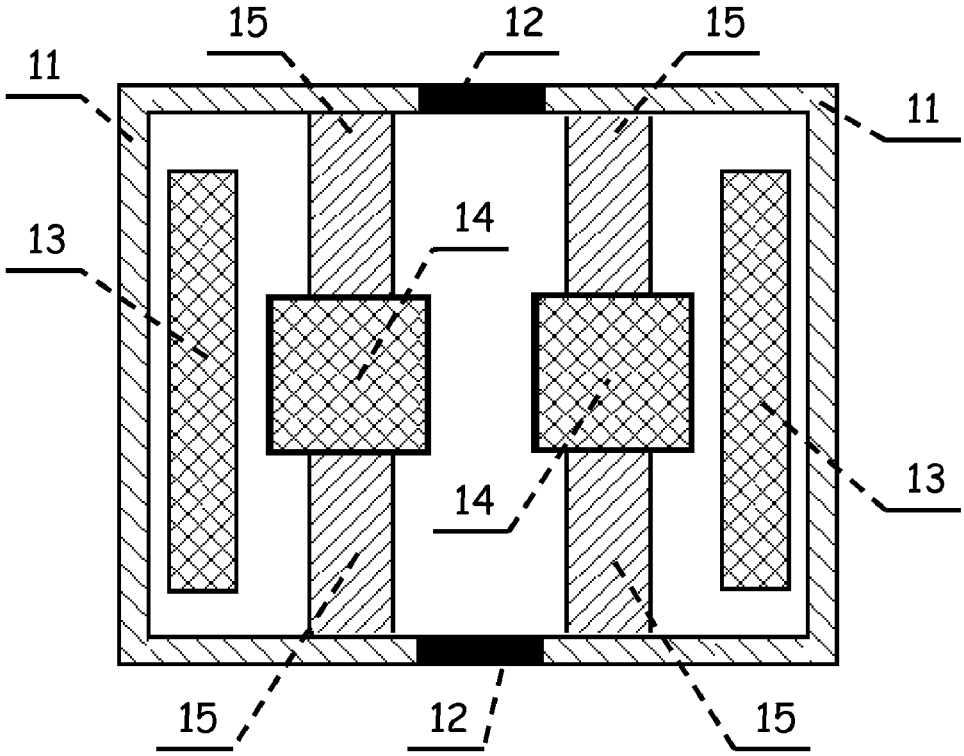
FIG. 1 is the schematic diagram of an embodiment of a waterproof insulated connector of this invention, which is in the initial state of contact.
Figure 2:
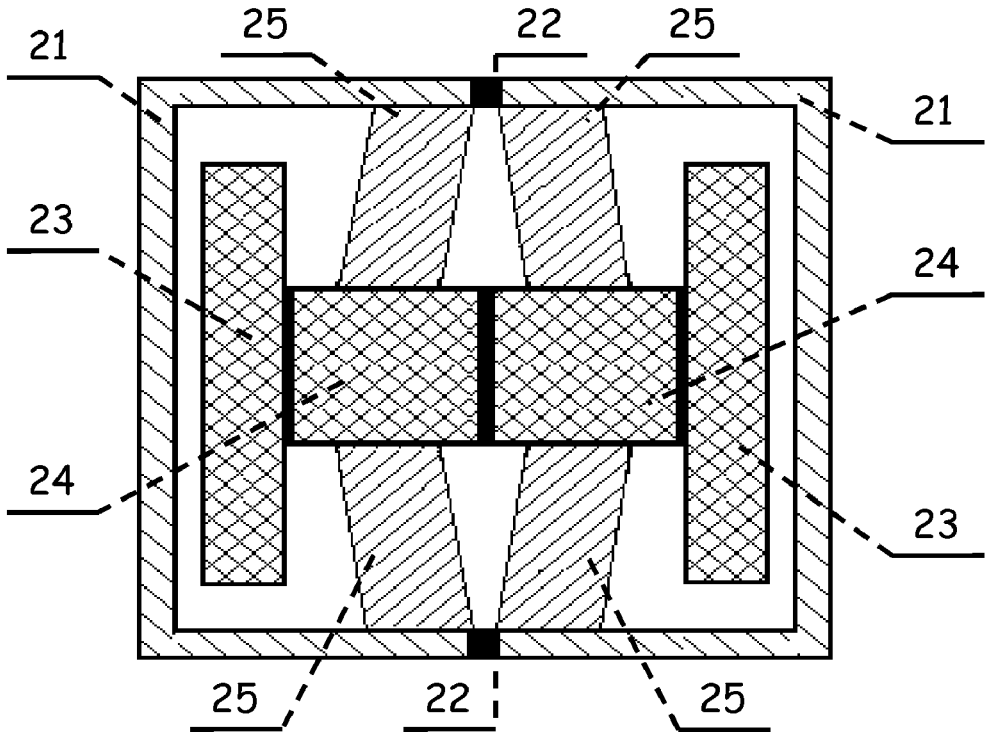
FIG. 2 is the schematic diagram of the waterproof insulated connector of the embodiment in FIG. 1 in the final state of contact.

The specific embodiment 1 of the invention, as shown in FIG. 1, is a waterproof insulated connector with the shell 11. A hollow waterproof ring 12 is at the opening of the shell 11, and the contacts 13 is installed inside the shell 11 and connects with the object that is received by connector. The dielectric elastomer 15 of the gating isolate component is affixed at the opening of the shell 11. The movable conductor 14 is affixed on the dielectric elastomer 15 and pass through it. Conductor 14 can connect or disconnect from the contacts 13 as dielectric elastomer 15 deforms. The gating isolate component and the shell 11 surround the contact completely. The isolating cavity deforms as the hollow waterproof ring undergoes elastic deformation when connection occurs. This isolates the movable conductors 14. Furthermore, movable conductors 14 exert pressure on each other to push the gating isolate component to enable the contact 13 to realize waterproof and insulated connection via the conductions of conductors 14, as shown in FIG. 2.

Horizontal-pressure waterproof insulated connector embodiment of the invention is based on the embodiment 1.

Figure 3:
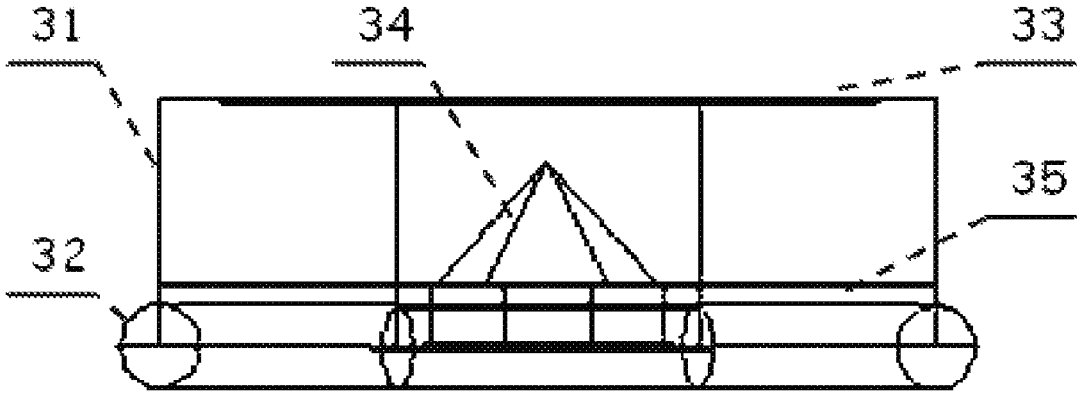
FIG. 3 is the plan view of an embodiment of a horizontal-pressure waterproof insulated connector of this invention.

The horizontal-pressure waterproof insulated connector, as shown in FIG. 3, includes shell 31, hollow waterproof ring 32, contacts 33, movable conductor 34, and dielectric elastomer 35. The structure of the horizontal-pressure waterproof insulated connector is clearly shown in FIG. 4, its stereogram, of which, the hollow waterproof ring 32 is installed at the opening of the shell 31; the contact 33 is installed inside the shell 31 and connects with the object that is—received by the connector; the dielectric elastomer 35 of the gating isolate component is affixed at the opening of the shell 31; Conductor 34 is affixed on the dielectric elastomer 35 and pass through it, which can contact or disconnect from the contact 33 with the deformation of the dielectric elastomer 35. The gating isolate component and the shell 31 surround the contacts 33 completely.

Figure 5:
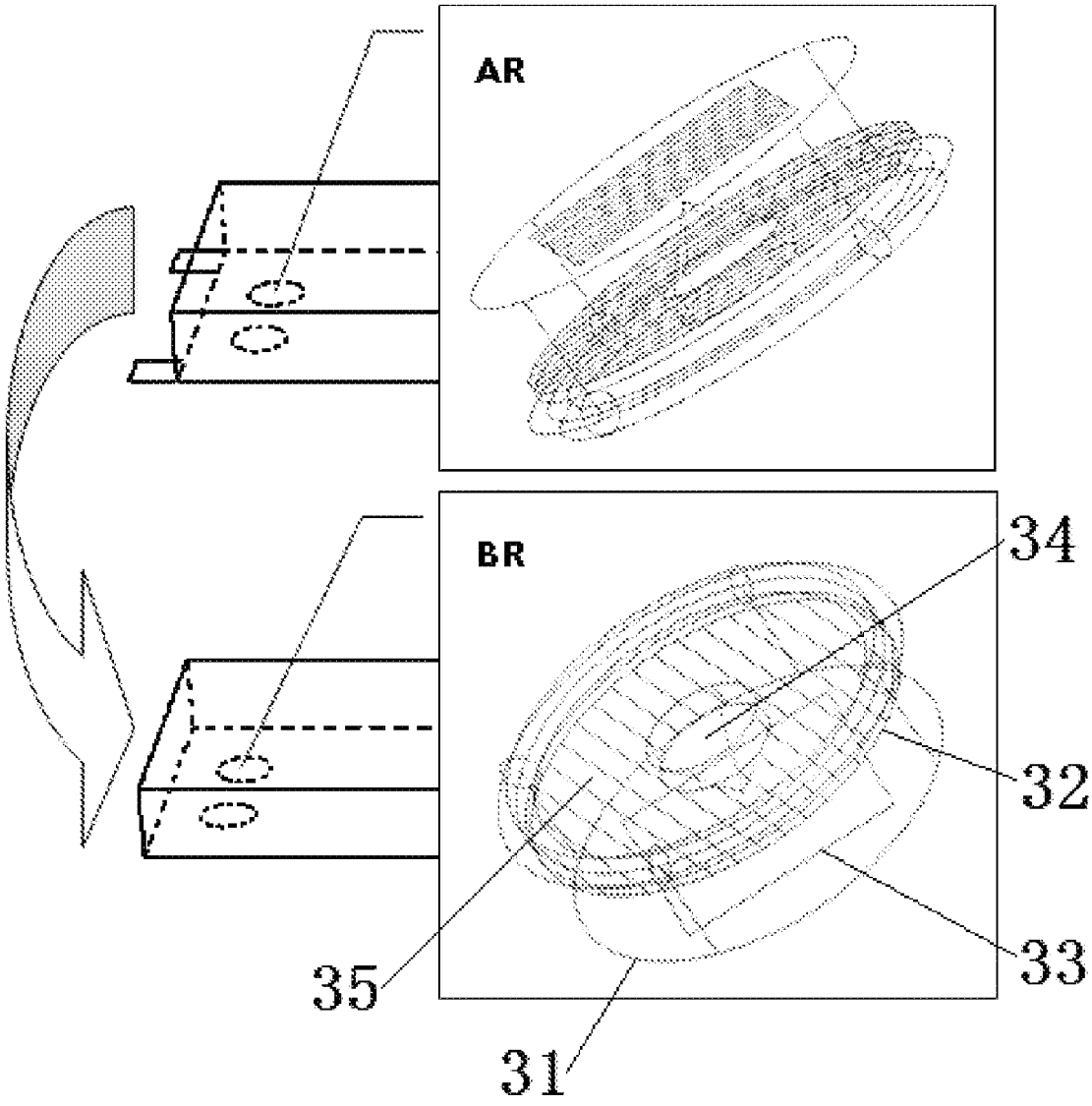
FIG. 5 is the schematic diagram of a horizontal-pressure waterproof insulated connector of this invention being used with batteries.

One actual application of the horizontal-pressure waterproof insulated connector is clearly shown in FIG. 5, the schematic diagram of horizontal-pressure waterproof insulated connector being used with batteries. In FIG. 5, AR illustrates the application mode of the horizontal-pressure waterproof insulated connector in one connecting object, and BR shows that in another connecting object.

Figure 4:
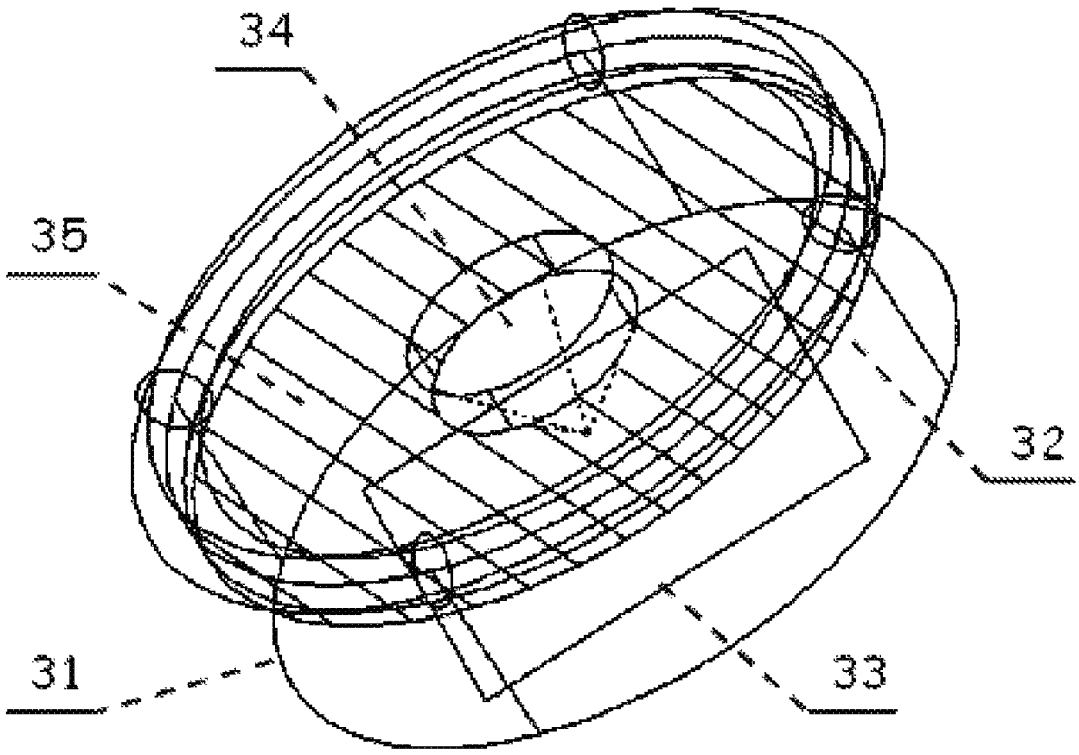
FIG. 4 is the stereogram of the horizontal-pressure waterproof insulated connector shown in FIG. 3.
Figure 6:
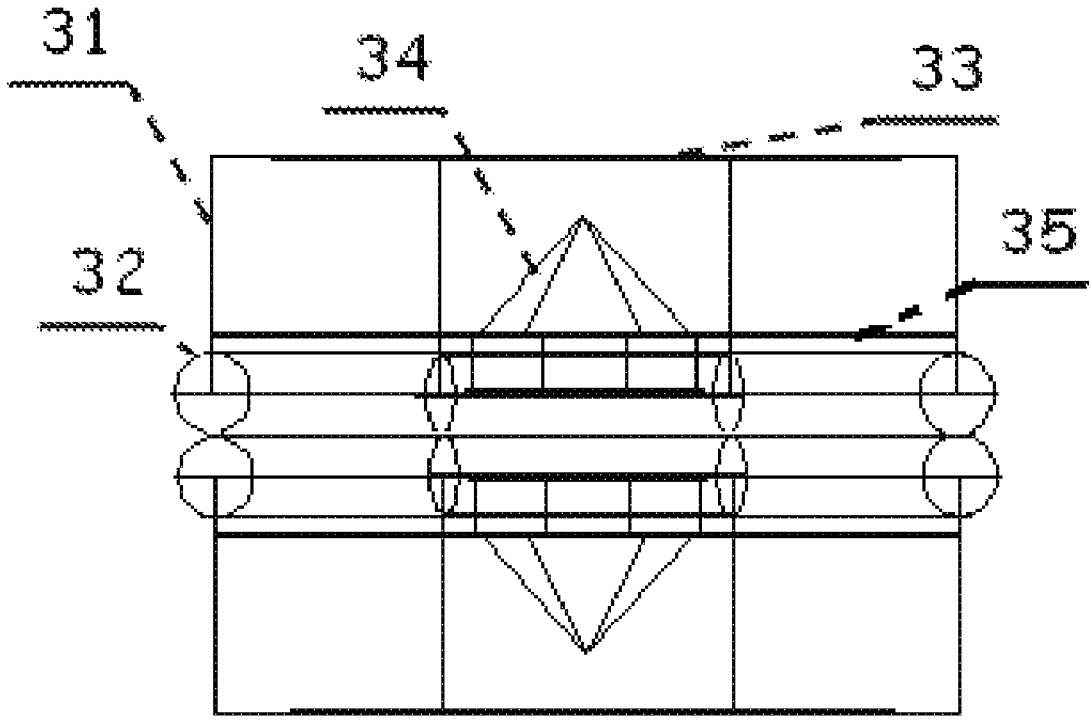
FIG. 6 is the schematic diagram of the horizontal-pressure waterproof insulated connector shown in FIG. 3 in the initial state of contact.
Figure 7:
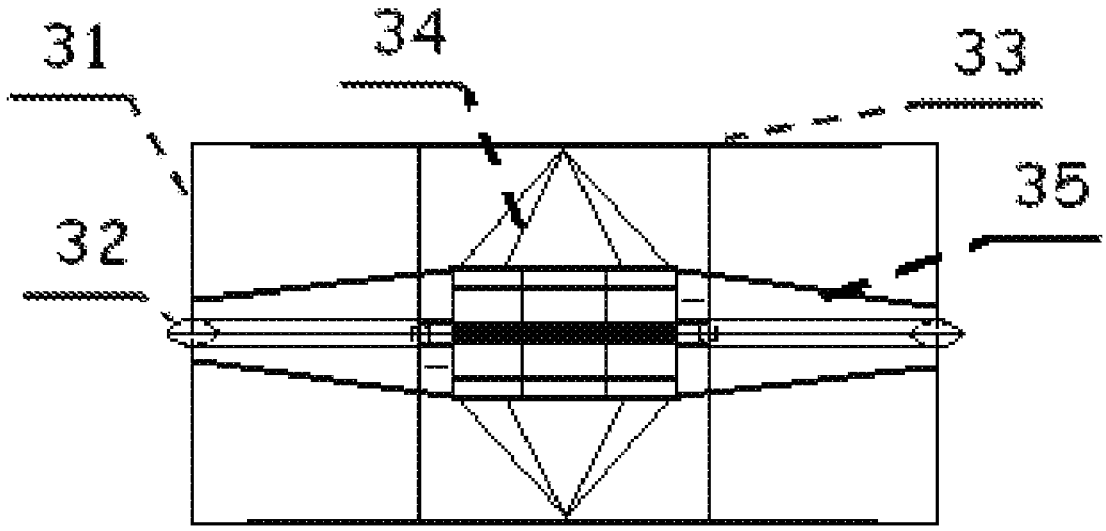
FIG. 7 is the schematic diagram of the horizontal-pressure waterproof insulated connector shown in FIG. 3 in the final state of contact.

As shown in FIG. 4, when the horizontal-pressure waterproof insulated connector is connected, the two hollow waterproof rings 32 contact with each other to form the isolating cavity with the shell 31 to isolate the two movable conductors 34. In this situation, the movable conductors 34 are separate from the two contacts 33. The initial state of contact of the horizontal-pressure waterproof insulated connector is shown in FIG. 6. After applying pressure, the hollow waterproof rings 32 deform and form the isolating cavity together with the shell 31. The two movable conductors 34 come into contact and exert pressure on each other to push the gating isolate component comprising the elastic insulator 35 and the movable conductor 34. The elasticity provided by dielectric elastomer 35 is overcome, and the two movable conductors 34 contact with the two contacts 33 to realize the waterproof and insulated connection. The final state of contact of the horizontal-pressure waterproof insulated connector is shown in FIG. 7.

Figure 8:
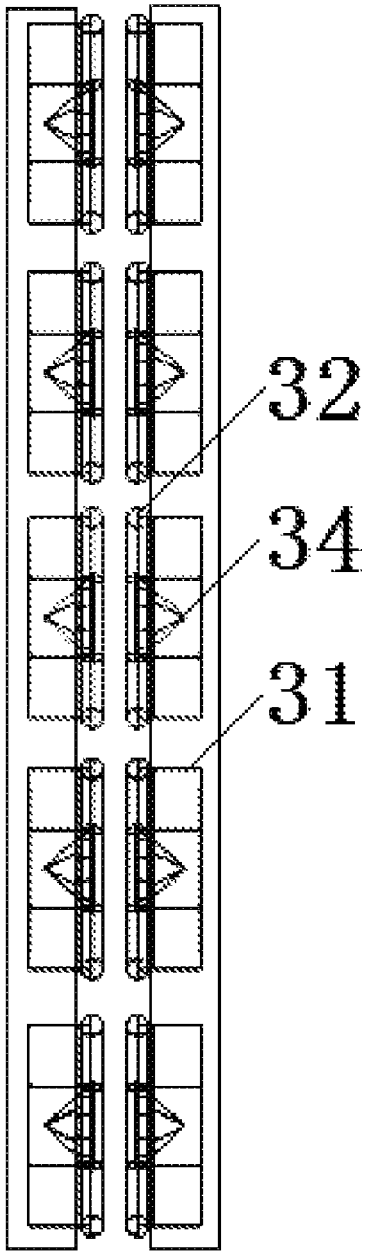
FIG. 8 is schematic diagram of horizontal-pressure waterproof insulated connectors of this invention being used in multiple electric passages.
Figure 9:
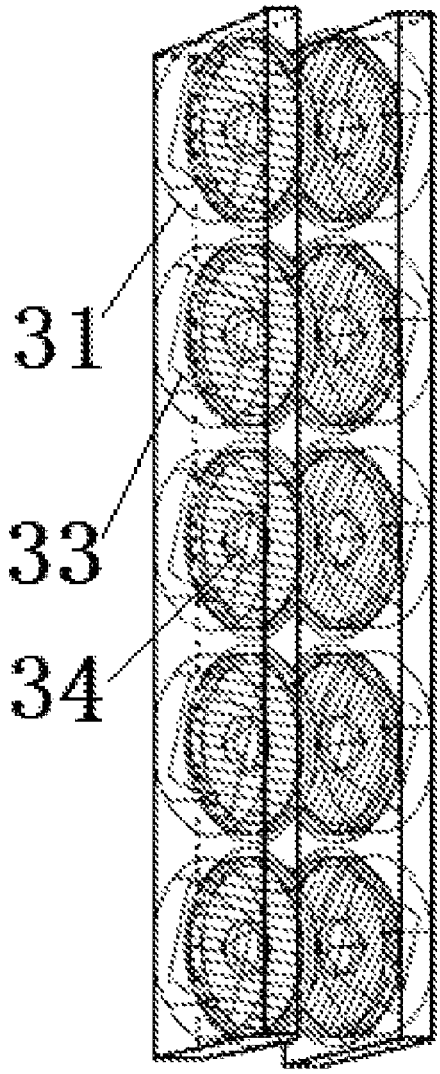
FIG. 9 is the stereogram of the embodiment shown in FIG. 8.

As for the embodiment in which the horizontal-pressure waterproof insulated connectors are used for multiple electric passages, it can be realized by the parallel connection of horizontal-pressure waterproof insulated connectors. The multiple-passage application schematic diagrams are as shown in FIG. 8 and FIG. 9.

Side-pressure waterproof insulated connector is another embodiment of the invention.

Figure 10:
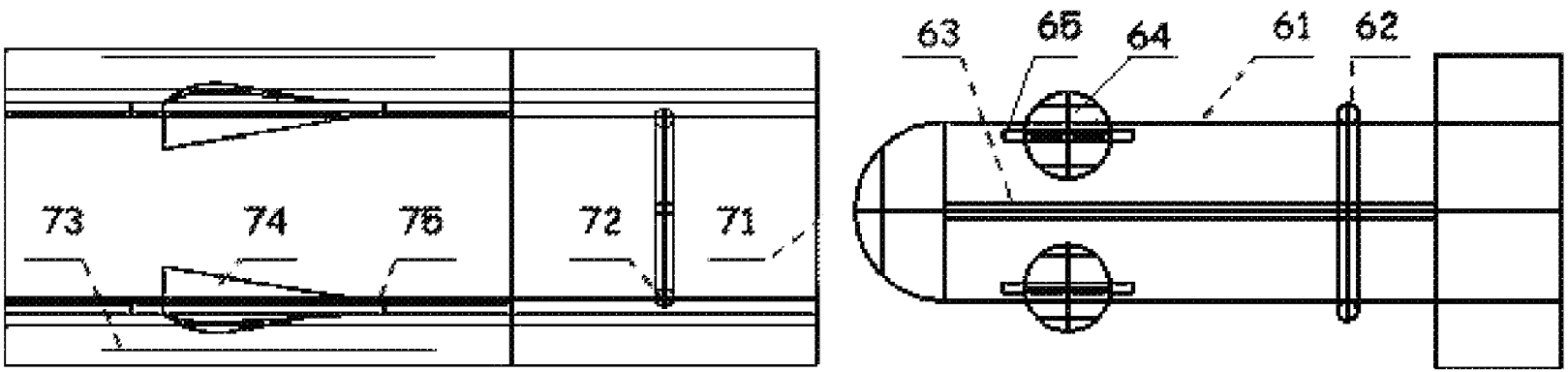
FIG. 10 is the schematic diagram of an embodiment of a side-pressure waterproof insulated connector of this invention.
Figure 11:
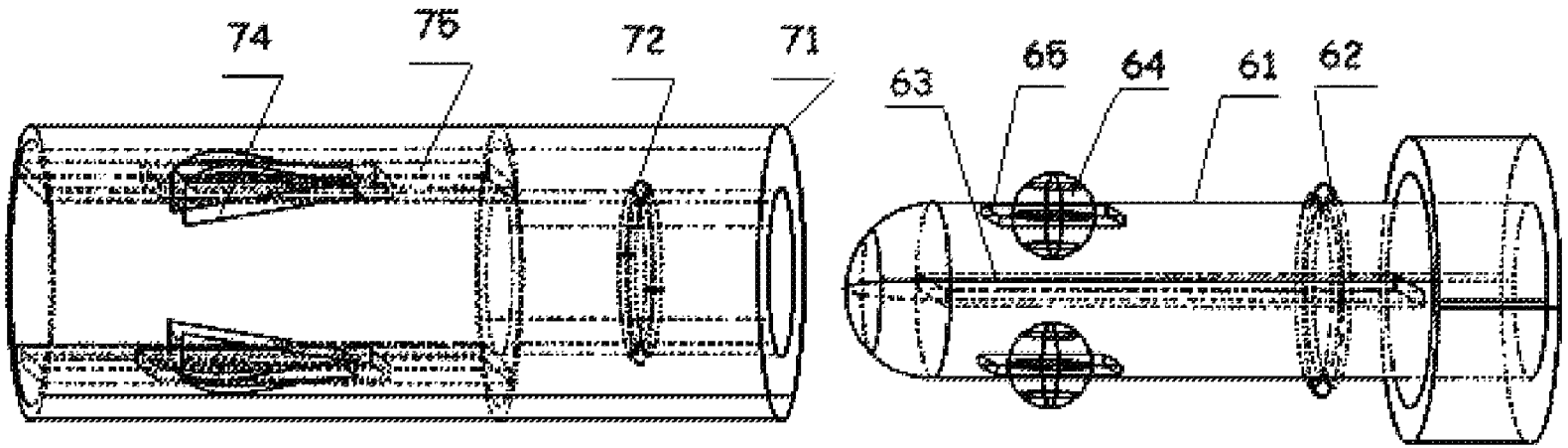
FIG. 11 is the stereogram of the embodiment shown in FIG. 10.

The side-pressure waterproof insulated connector is shown in FIG. 10. Its socket comprises shell 71, hollow waterproof ring 72, contacts 73, movable conductor 74, and dielectric elastomer 75. Its plug comprises shell 61, hollow waterproof ring 62, contacts 63, movable conductor 64, and dielectric elastomer 65. The structure of the side-pressure waterproof insulated connector is clearly shown in FIG. 11, its stereogram.

When the side-pressure waterproof insulated connector is connected, hollow waterproof ring 62 and hollow waterproof ring 72 contact with each other to form the isolating cavity together with the shell 61 and the shell 71 to isolate the movable conductor 64 and the movable conductor 74. In this situation, the movable conductor 64 and the movable conductor 74 are separated from the contact 63 and the contact 73. After further applying pressure, conductor 64 and conductor 74 contact with and press on each other to push the gating isolate component comprising dielectric elastomer 65, dielectric elastomer 75 and conductor 64, conductor 74, overcoming elasticity provided by dielectric elastomer 65 and dielectric elastomer 75. Consequently, movable conductor 64, movable conductor 74 contact with the contacts 63 and the contacts 73 respectively to realize the waterproof and insulated connection.

Figure 12:
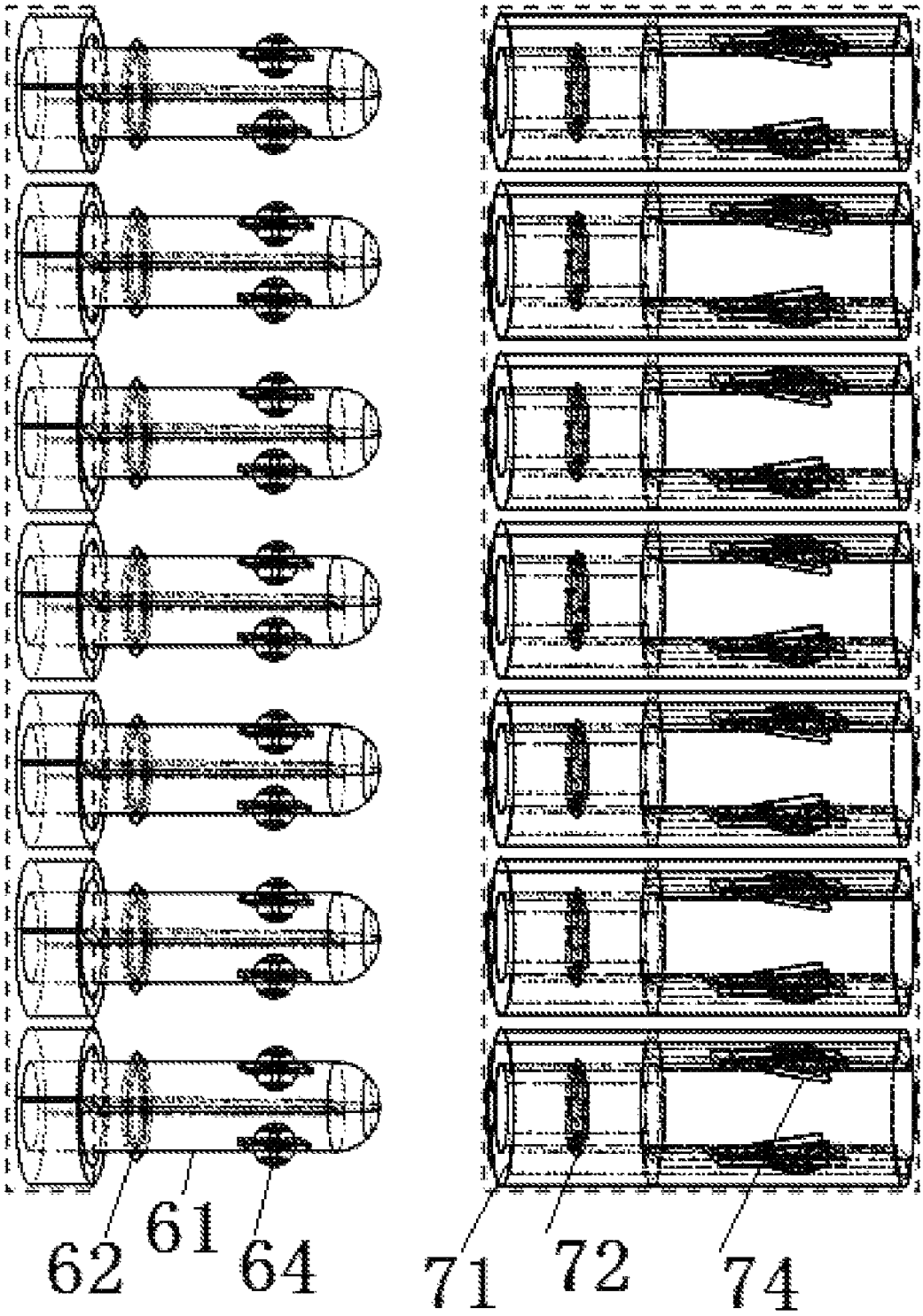
FIG. 12 is the schematic diagram of side-pressure waterproof insulated connectors of this invention being used in multiple electric passages.

As for the embodiment in which the side-pressure waterproof insulated connector are used for multiple electric passages, it can be realized by the parallel connection of horizontal-pressure waterproof insulated connectors of the said embodiment. The multiple-passage application schematic diagram is as shown in FIG. 12.

Figure 13:
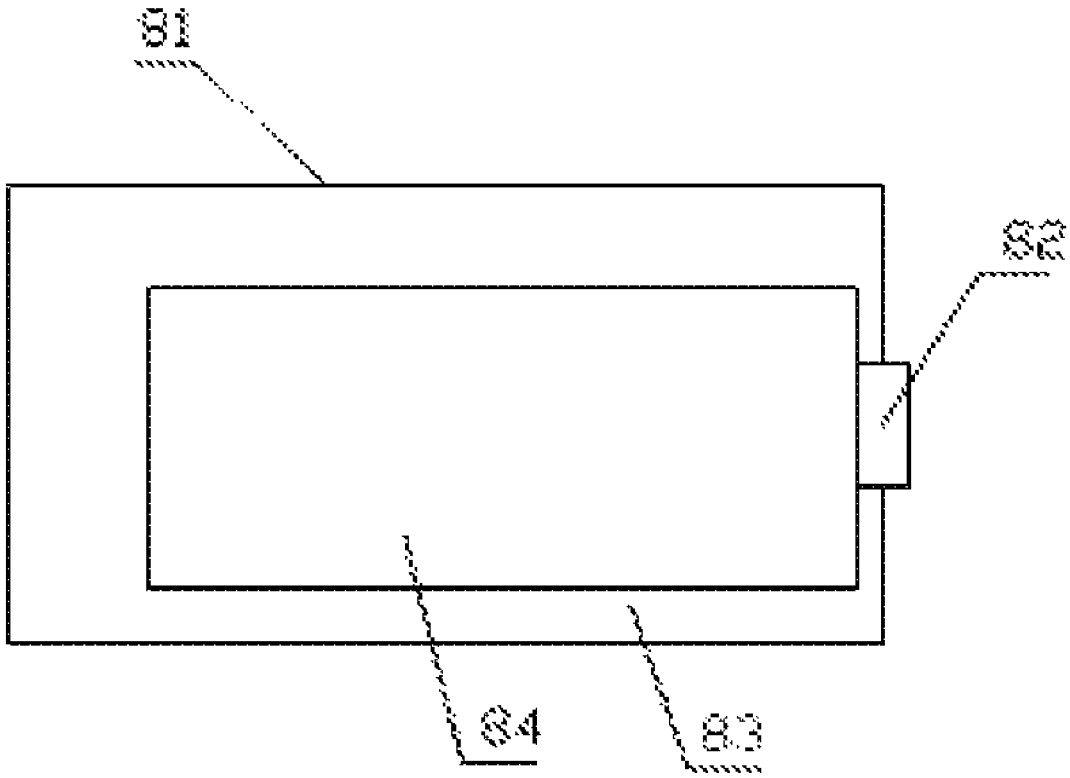
FIG. 13 is the schematic diagram of a waterproof insulated connector of the invention coupled with an electric equipment.

One specific embodiment of the invention, as shown in FIG. 13, is to apply the said waterproof insulated connector in specific electric equipment to realize its waterproof function. The waterproof cavity is formed by the waterproof insulation layer 81 and the shell of the waterproof insulated connector 82 to enfold the electric equipment 84. Then, the electric equipment 84 connects with the outside via the waterproof insulated connector 82. In one specific example of the embodiment, a waterproof mobile or an audio player is enfolded in the waterproof insulation layer 81, and connected with the outside via the said waterproof insulated connector 82, which not only ensure the electric connection between the electric equipment and the outside world, but also fully guarantee the waterproof function of the equipment.

All features, methods, or steps publicized in the specification, except the mutually exclusive features and/or steps, can be combined in any possible way.

Any feature publicized in the specification (including any attached claims, abstract and drawings), unless specifically described, can be replaced by alternative features of the same performance or similar aims. Namely, unless specifically described, each feature is only one example of a series equivalent or similar features.

The invention is not limited to the specific embodiments described herein. The invention can be expanded to any new feature, combination, method, or step in the method or process disclosed in the specification.

We claim:

1. A waterproof insulated connector, comprising:

a plug and a socket, said plug comprises a first shell, a first hollow waterproof ring, a first contact, and a first gating isolate component comprising a movable conductor and a first dielectric elastomer; and said socket comprises a second shell, a second hollow waterproof ring, a second contact, and a second gating isolate component comprising a second movable conductor and a second dielectric elastomer, wherein the first movable conductor is affixed on the first dielectric elastomer and the second movable conductor is affixed on the second dielectric elastomer, wherein when the plug and the socket are connected, the first hollow water proof ring and the second hollow waterproof ring contact each other to form an isolating cavity which encapsulates the first gating isolate component and the second gating isolate component, and the first dielectric elastomer and the second dielectric elastomer undergo elastic deformation so that the first movable conductor contacts the first contact and the second movable conductor contacts the second contact.

2. A waterproof insulated connector as claimed in claim 1, wherein the connecting mode of the said plug and socket is horizontal-pressure, wherein a direction of movement of the first movable conductor is parallel to a direction of movement of the plug along which the plug inserts into the socket.

3. A waterproof insulated connector as claimed in claim 1, which is characterized in that: the connecting mode of the said plug and socket is side-pressure, wherein a direction of movement of the first movable conductor is perpendicular to a direction of movement of the plug along which the plug inserts into the socket.

4. A type of electrical equipment that includes the waterproof insulated connector as claimed in claim 1, characterized in that, the electrical equipment connects with another equipment through the waterproof insulated connector.

* * * * *